US009004461B2

(12) United States Patent
Schwendinger et al.

(10) Patent No.: US 9,004,461 B2
(45) Date of Patent: Apr. 14, 2015

(54) HUMIDIFIER WITH FIELD-REPLACEMENT COMPONENTS

(71) Applicant: Honeywell International Inc., Morristown, NJ (US)

(72) Inventors: Paul Schwendinger, North Branch, MN (US); David J. Emmons, Plymouth, MN (US); Andrew Morris, Owatonna, MN (US); XinHua Cao, Morristown, NJ (US); Eric Barton, Eden Prairie, MN (US); Steven Wolff, Hamel, MN (US)

(73) Assignee: Honeywell International Inc., Morristown, NJ (US)

( * ) Notice: Subject to any disclaimer, the term of this patent is extended or adjusted under 35 U.S.C. 154(b) by 318 days.

(21) Appl. No.: 13/685,394

(22) Filed: Nov. 26, 2012

(65) Prior Publication Data

US 2014/0145358 A1 May 29, 2014

(51) Int. Cl.
*B01F 3/04* (2006.01)
*F24F 6/18* (2006.01)

(52) U.S. Cl.
CPC . *F24F 6/18* (2013.01); *Y10S 261/65* (2013.01)

(58) Field of Classification Search
CPC ..... B01F 3/04; B01F 3/04021
USPC ..... 261/141, 142, 129, 130, 119.1, DIG. 65
See application file for complete search history.

(56) References Cited

U.S. PATENT DOCUMENTS

| | | | |
|---|---|---|---|
| 2,101,603 | A | 12/1937 | Stimson |
| 3,491,746 | A | 1/1970 | Swimmer et al. |
| 3,570,822 | A | 3/1971 | Peterson et al. |
| 3,672,706 | A | 6/1972 | Chilcoat |
| 4,158,679 | A | 6/1979 | Yeagle |
| D253,846 | S | 1/1980 | Morrow |
| D258,609 | S | 3/1981 | Vogt |

(Continued)

FOREIGN PATENT DOCUMENTS

| | | |
|---|---|---|
| JP | 54023240 | 2/1979 |
| JP | 1003442 | 9/1989 |
| JP | 2004293936 | 10/2004 |

OTHER PUBLICATIONS

"Bypass Flow-Through Humidifier", Honeywell, HE225, 69-1425EF-03, 8 pages, 2010.

(Continued)

*Primary Examiner* — Robert A Hopkins
(74) *Attorney, Agent, or Firm* — Seager Tufte & Wickhem LLC.

(57) ABSTRACT

A humidifier having a field-replaceable water heating enclosure and a humidifier main unit configured to receive the field-replaceable water heating enclosure is provided. The field-replaceable water heating enclosure may include a water inlet, a water outlet, a water vapor outlet, and a resistive heating element. The humidifier main unit may be configured to provide water to the field-replaceable water heating enclosure via the water inlet when the field-replaceable water heating enclosure is received by the humidifier main unit. To facilitate this, the humidifier main unit may include a manifold structured to interface with the water inlet, the water outlet, and the water vapor outlet. The humidifier main unit also may be configured to provide electrical power to the resistive heating element of the field-replaceable water heating enclosure when the field-replaceable water heating enclosure is received by the humidifier main unit.

20 Claims, 10 Drawing Sheets

(56) References Cited

U.S. PATENT DOCUMENTS

| | | | |
|---|---|---|---|
| D280,660 | S | 9/1985 | Muchenberger |
| D281,271 | S | 11/1985 | Meyer et al. |
| 4,559,789 | A | 12/1985 | Riek |
| 4,564,746 | A | 1/1986 | Morton et al. |
| D283,265 | S | 4/1986 | Preskey et al. |
| 4,589,409 | A | 5/1986 | Chatburn et al. |
| D320,072 | S | 9/1991 | Youngeberg |
| D322,122 | S | 12/1991 | Guetersloth et al. |
| 5,075,047 | A | 12/1991 | Youngeberg |
| D338,952 | S | 8/1993 | Snow |
| 5,252,260 | A | 10/1993 | Schuman |
| D342,989 | S | 1/1994 | Wallen |
| D370,254 | S | 5/1996 | Dancs et al. |
| 5,598,971 | A | 2/1997 | Winther et al. |
| 5,851,444 | A | 12/1998 | Hansell, Jr. et al. |
| D409,737 | S | 5/1999 | Nilsson |
| D416,994 | S | 11/1999 | Kensok et al. |
| 6,354,572 | B1 | 3/2002 | Menassa |
| D456,887 | S | 5/2002 | Zlotnik |
| D458,356 | S | 6/2002 | Redner et al. |
| 6,588,734 | B2 | 7/2003 | Redner et al. |
| D486,896 | S | 2/2004 | Long et al. |
| D492,759 | S | 7/2004 | Yoshida |
| 6,845,755 | B2 | 1/2005 | Cook et al. |
| D516,192 | S | 2/2006 | Kang |
| D516,689 | S | 3/2006 | Salmon et al. |
| D519,622 | S | 4/2006 | Cocchi |
| D532,497 | S | 11/2006 | Engel et al. |
| D538,416 | S | 3/2007 | Ediger et al. |
| D540,819 | S | 4/2007 | Schmitt et al. |
| D540,929 | S | 4/2007 | Kowis et al. |
| D554,246 | S | 10/2007 | Seelig et al. |
| D557,784 | S | 12/2007 | Stead |
| D573,703 | S | 7/2008 | Gosselin et al. |
| 7,434,741 | B2 | 10/2008 | Helt et al. |
| D593,190 | S | 5/2009 | Glass |
| D596,728 | S | 7/2009 | Campbell et al. |
| D598,526 | S | 8/2009 | Pitchford et al. |
| D600,252 | S | 9/2009 | Yan et al. |
| D630,310 | S | 1/2011 | Beland et al. |
| D631,145 | S | 1/2011 | Beland et al. |
| 8,231,112 | B2 | 7/2012 | Cao et al. |
| 8,292,270 | B2 | 10/2012 | Terlson et al. |
| 8,302,943 | B2 | 11/2012 | Wang et al. |
| 2008/0079177 | A1 | 4/2008 | Schuld |
| 2011/0067851 | A1 | 3/2011 | Terlson et al. |
| 2011/0068486 | A1 | 3/2011 | Quam et al. |
| 2011/0068490 | A1 | 3/2011 | Wang et al. |
| 2012/0097163 | A1 * | 4/2012 | Potharaju et al. ..... 128/203.26 |

OTHER PUBLICATIONS

"HE360 Powered Flow-Through Humidifier", Honeywell, 69-1117, 8 pages, 1997.

"Owner's Manual for Models 110, 112, 220, 224, 350, 360, 440, 445, 448, 558, 560, 568, 760 & 768", Aprilaire Humidifiers, 20 pages, 2005.

"Owner's Manual for Models 350, 360, 400, 400M, 500, 500M, 600, 600M, 700 & 700M", Aprilaire Humidifiers, 11 pages, 2010.

Aprilaire, "Model 800 residential Steam Humidifier," 16 pages, Downloaded Sep. 17, 2012.

Aprilaire, "Steam Humidifier," Research Products Corporation,9 pages, © 2010.

Carel, "HumiSteam x-Plus," Carel Industries, 60 pages, Downloaded Sep. 17, 2012.

Carrier Humidifiers Homeowner's Manual, 8 pages, 1998.

JS Humidifiers PLC, "Condair Mk5," 4 pages, Downloaded Oct. 12, 2012.

Michigan Air Products, "Map to HVAC Solutions," Issue 1, 4 pages, 2011.

* cited by examiner

HUMIDIFIER WITH FIELD-REPLACEMENT COMPONENTS

TECHNICAL FIELD

The disclosure relates generally to humidifiers, and more particularly, to humidifiers with field-replaceable components.

BACKGROUND

In dry or colder climates, it is often desirable to add moisture to the air that is inside of an enclosed space such as a building in order to maintain suitable humidity levels. There are a variety of products on the market that employ various techniques to provide humidification including, for example, steam injection, water atomization, and evaporation. Such humidifiers are often used in conjunction with forced air residential and commercial heating, ventilation, and air conditioning (HVAC) systems.

A steam type humidifier typically heats water to make steam, and then provides the steam into a desired air stream, such as a duct of a forced air HVAC system. Such steam humidifiers are typically connected to a water source of the building, and draw the water from the water source into a water tank. The water in the water tank is then heated to produce steam. The humidifier may generally alternate or cycle between heating and non-heating states, depending on the demand for humidity by the system. In many cases, the water contains certain impurities such as certain minerals, chemicals and/or other impurities. When this water is boiled, some or all of the impurities tend to be left behind, and if not removed, can build up and ultimately degrade humidifier performance. Built-up deposits of impurities are sometimes referred-to as "scale." What would be desirable, are steam humidifiers that include features to help counter the effects of scale buildup on humidifier performance.

SUMMARY

The disclosure relates generally to humidifiers, and more particularly, to humidifiers with field-replaceable components. In one illustrative embodiment, a humidifier having a field-replaceable water heating enclosure and a humidifier main unit configured to receive the field-replaceable water heating enclosure is provided. The field-replaceable water heating enclosure may include a water inlet, a water outlet, a water vapor outlet, and a resistive heating element. The humidifier main unit may be configured to provide water to the field-replaceable water heating enclosure via the water inlet when the field-replaceable water heating enclosure is received by the humidifier main unit. To facilitate this, the humidifier main unit may include a manifold structured to interface with the water inlet, the water outlet, and the water vapor outlet. The humidifier main unit also may be configured to provide electrical power to the resistive heating element of the field-replaceable water heating enclosure when the field-replaceable water heating enclosure is received by the humidifier main unit. The humidifier main unit may include an electrical connector that includes a plurality of electrical contacts that facilitates this function.

In another illustrative embodiment, a humidifier having a field-replaceable water heating enclosure and a humidifier main unit configured to receive the field-replaceable water heating enclosure is provided. The field-replaceable water heating enclosure may include a water inlet, a water outlet, a water vapor outlet, and an electrical heating device. The humidifier main unit may include an electrical connector having a plurality of electrical contacts. The plurality of electrical contacts may include a pair of electrical contacts configured to provide electrical power to the electrical heating device. Each of the plurality of electrical contacts may correspond to a mating electrical contact on the field-replaceable water heating enclosure. The electrical connector may be structured to maintain the plurality of electrical contacts in a substantially fixed relative spatial relationship. The electrical connector may be structured to mate the plurality of electrical contacts with corresponding mating electrical contacts on the field-replaceable water heating enclosure when the electrical connector is attached to the field-replaceable water heating enclosure in a single action. In some instances, the electrical connector further includes one or more temperature sensors. The electrical connector may be structured to position the one or more temperature sensors in thermal communication with the field-replaceable water heating enclosure when the electrical connector is attached to the field-replaceable water heating enclosure.

In yet another illustrative embodiment, a humidifier having a field-replaceable water heating enclosure and a humidifier main unit configured to receive the field-replaceable water heating enclosure is provided. The field-replaceable water heating enclosure may include a water inlet, a water vapor outlet, and a heating device configured to heat water in the field replaceable water heating enclosure. The humidifier main unit may be configured to provide water to the field-replaceable water heating enclosure via the water inlet and receive water vapor from the field-replaceable water heating enclosure via the water vapor outlet. To facilitate these functions, the humidifier main unit may include a manifold structured to fluidically connect with the water inlet and the water vapor outlet when the field-replaceable water heating enclosure is received by the humidifier main unit.

The above summary is not intended to describe each and every example or every implementation of the disclosure. The Description that follows more particularly exemplifies various illustrative embodiments.

BRIEF DESCRIPTION OF THE FIGURES

The following description should be read with reference to the drawings. The drawings, which are not necessarily to scale, depict selected illustrative embodiments and are not intended to limit the scope of the disclosure. The disclosure may be more completely understood in consideration of the following detailed description of various illustrative embodiments in connection with the accompanying drawings, in which.

DESCRIPTION

The following description should be read with reference to the drawings, in which like elements in different drawings are numbered in like fashion. The drawings, which are not necessarily to scale, depict selected illustrative embodiments and are not intended to limit the scope of the disclosure. Although examples of construction, dimensions, and materials are illustrated for the various elements, those skilled in the art will recognize that many of the examples provided have suitable alternatives that may be utilized.

The present disclosure relates to appliances with water reservoirs. The teachings of the present disclosure may be particularly relevant to humidifiers, and even more particularly, to humidifiers that heat water to increase the rate of production of water vapor, in many cases boiling water to produce steam. Over time, heating of water and the production of water vapor generally results in a buildup of byproducts such as sediment, minerals, debris, and the like, sometimes referred to as "scale." Water-heating appliances such as steam humidifiers may be particularly susceptible to scale resulting from dissolved minerals with reduced solubility at high temperatures, such as calcium and magnesium carbonates and sulfates. Scale buildup may also occur in other water-handling appliances that do not heat water. If allowed to accumulate, scale may result in one or more undesirable effects, such as reduced heat transfer from heating elements, reduced capacity in the water reservoir, clogging of water passages, etc.

The present disclosure presents methods and devices to help counter the effects of scale accumulation on the performance of humidifiers, as well as other appliances that suffer degradation from scale buildup. Devices, methods, and strategies disclosed herein may include purposely incorporating scale collection features in appliances, and/or providing for replacement of components that have collected scale. Component replacement may also be necessary or desirable for reasons other than scale accumulation, and the teachings of the present disclosure may be advantageously applied in those scenarios as well. These are just some examples.

Figure 1:
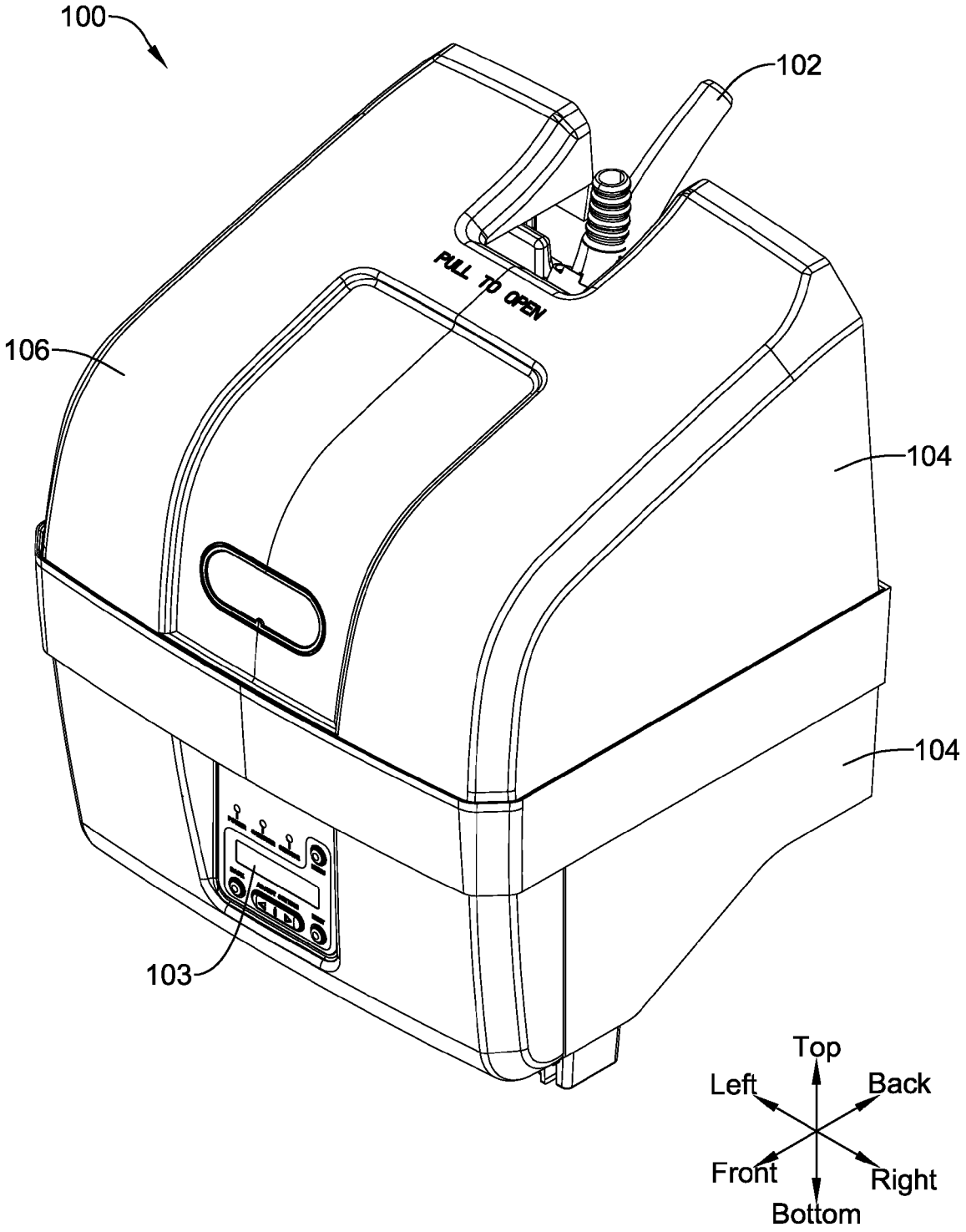
FIG. 1 is a perspective view of an illustrative humidifier.

FIG. 1 is a perspective view of an illustrative humidifier 100. In some examples, humidifier 100 may be a steam humidifier, but this is not required. In some instances, humidifier 100 may provide non-steam water vapor for humidification. Illustrative humidifiers, referred-to as steam humidifiers herein, generally may also illustrate features of non-steam water vapor humidifiers, and a feature of such a humidifier such as a "steam port," for example, may also be regarded as a "water vapor port," in as far as the interchangeability of steam and water vapor is technically feasible.

FIG. 1 shows a legend indicating directions such as top/bottom, front/back, and left/right, to facilitate discussion of the features of the illustrative humidifier(s). The association of any feature with any specific direction or orientation, however, is merely to aid the discussion and should not be considered limiting in any way.

In the example shown in FIG. 1, humidifier 100 may be mounted on or attached to an HVAC duct (not shown), and may include a water vapor port 102 configured to introduce steam from the humidifier 100 into an airstream within the HVAC duct. Humidifier 100 may include a connection (not shown) to an electric power supply to provide energy for powering its operation, and a connection (not shown) to a water supply to provide water to be evaporated and introduced as water vapor into the HVAC duct. Humidifier 100 may also include features (not shown) to connect to a sewer or other drainage system of a house, building, or other structure in which it may be installed. Humidifier 100 may include a controller (not shown) configured to control any appropriate aspects or features of the humidifier. The controller may include a user interface 103, which may be disposed on the exterior of the humidifier so as to be accessible by a user, but this is not required.

The portions of humidifier 100 visible in FIG. 1 may be considered to be part of the humidifier main unit. The humidifier main unit may include an outer enclosure 104. The outer enclosure 104 may include a selectively removable top panel 106 to provide access to the interior of the humidifier main unit. The opening in the outer enclosure 104 resulting from removal of the selectively removable panel 106 may be considered an access port. Through the access port, components of the humidifier, which may be disposed partially or entirely in the interior of the humidifier main unit, may be accessed in the field for maintenance and/or replacement.

Figure 2:
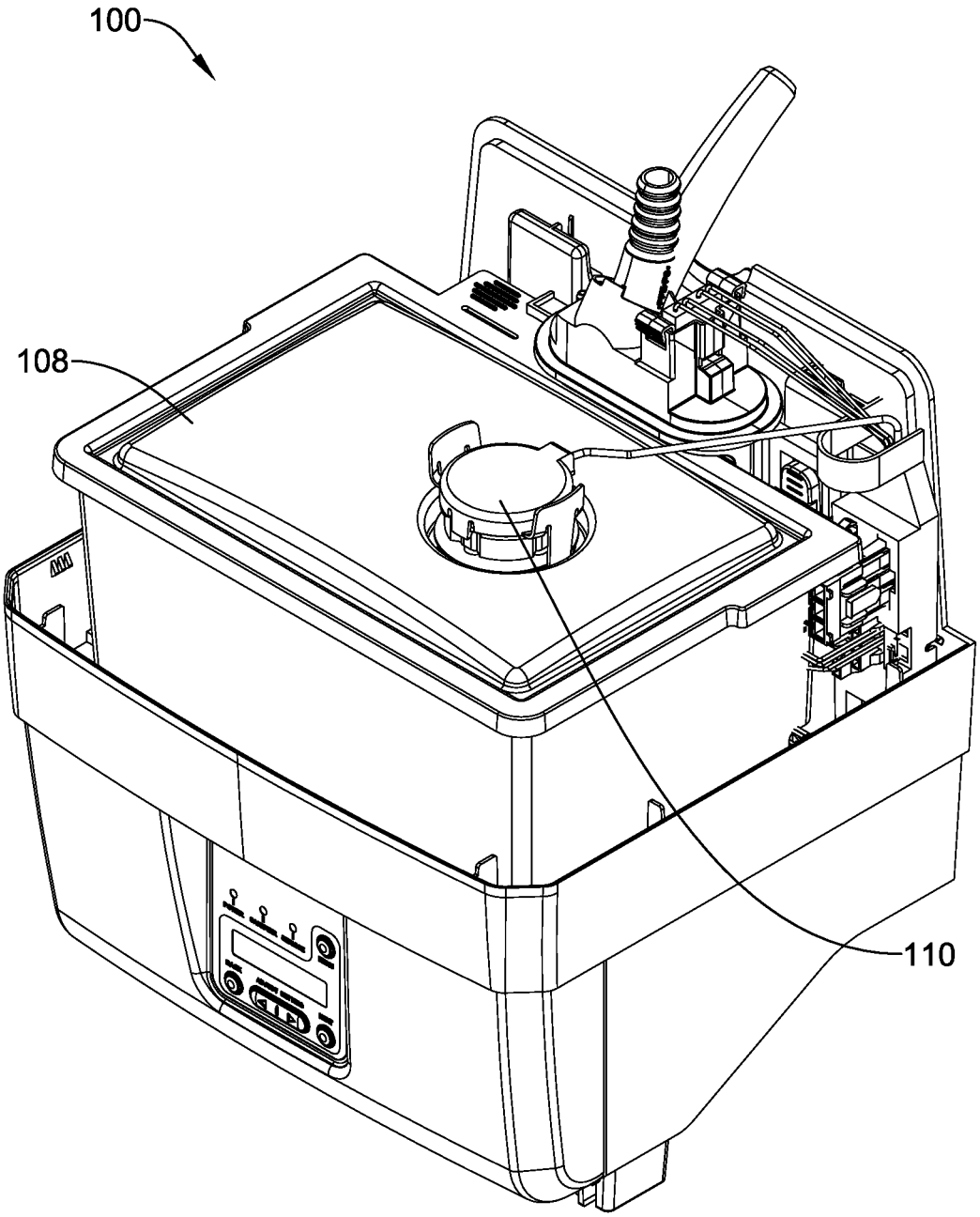
FIG. 2 is a perspective view of the illustrative humidifier of FIG. 1 after removal of a removable top panel.

FIG. 2 is a perspective view of the illustrative humidifier 100 of FIG. 1 after removal of the selectively removable top panel 106. In the example shown, the largest component in the interior of the humidifier main body is water heating enclosure 108, which may also be referred-to a chamber or a canister. In a steam humidifier, water heating enclosure 108 may be called a water boiling enclosure, chamber, or canister, etc. 108. Water heating enclosure 108 may be field-replaceable, although this is not necessary.

Humidifier 100 may be structured and configured for easy field replacement of water heating enclosure 108, which may then be considered a field-replaceable water heating enclosure. This may be facilitated, for example, by featuring convenient mechanisms for making and/or breaking connections, such as water and electrical connections, between a water heating enclosure 108 and the humidifier main unit. Electrical connections between the humidifier main unit and the water heating enclosure 108 may be made via an electrical connector 110. In some illustrative embodiments, all electrical connections between water heating enclosure 108 and the humidifier main unit are made through electrical connector 110, but this is not necessary. In some other illustrative embodiments, additional electrical connection mechanisms may be employed.

Electrical connector 110 may be configured to make any desired electrical connection between water heating enclosure 108 and the humidifier main unit. In some illustrative embodiments, water heating enclosure 108 includes an electrical heating device (not shown in FIG. 2) to which the electrical connector 110 may connect and provide electrical power when the water heating enclosure is received by the humidifier main unit. The electrical heating device may take any suitable form, and may be capable of providing any suitable heat output. In some illustrative embodiments, the electrical heating device may be configured to heat water in water heating enclosure to a boil, such that water vapor is produced rapidly in the form of steam. In some illustrative embodiments, the electrical heating device may be a resistive heating element or heater in thermal communication with water contained by the water heating enclosure 108. Such a resistive heating element may be essentially immersed in the water, or it may be disposed in or around the water heating enclosure 108 in any suitable manner to facilitate thermal energy transfer to the water. In other illustrative embodiments, the heating device may include electrodes that conduct current into water contained by the water heating enclosure 108, such that the transfer of current through the water provides a water heating mechanism. Other electrical heating devices and methods may be contemplated as well. In some illustrative embodiments of the present disclosure, non-electrical heating devices or heaters may be employed, such as combustion burners or other heating devices.

Figure 3:
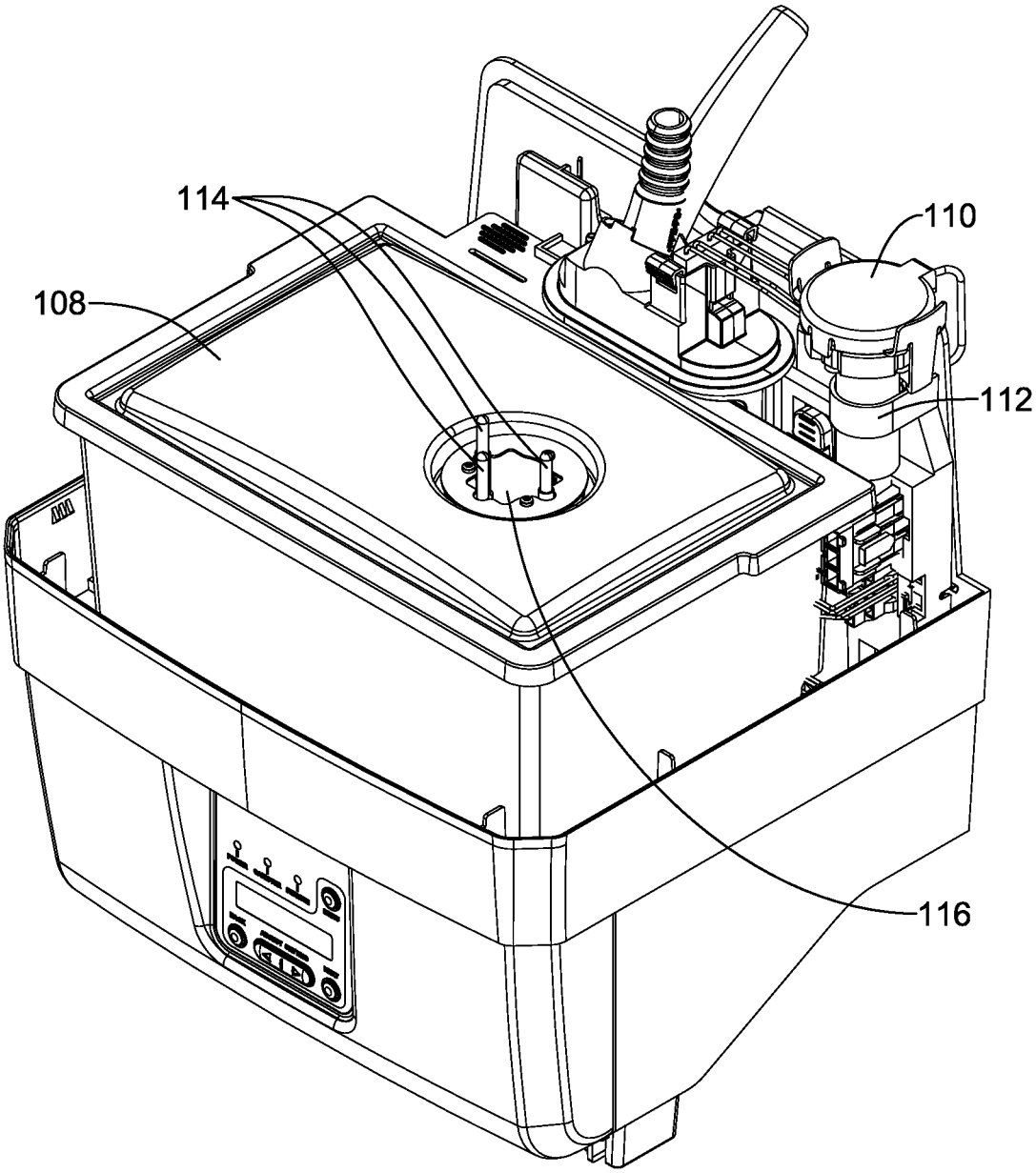
FIG. 3 is a perspective view of the illustrative humidifier of FIGS. 1 and 2 with an electrical connector detached from a water heating enclosure.

FIG. 3 is a perspective view of the illustrative humidifier 100 of FIGS. 1 and 2 with the electrical connector 110 detached from the water heating enclosure 108. In FIG. 3, electrical connector 110 is stowed in an optional bracket 112 of the humidifier main unit that may be included to provide a convenient storage location for the electrical connector during replacement of water heating enclosure 108 or any other appropriate maintenance activity. Electrical connector 110 may include a plurality of electrical contacts (not shown in FIG. 2), including a pair of electrical contacts configured to provide electrical power to the electrical heating device of the water heating enclosure 108. Water heating enclosure 108 may include mating electrical contacts 114 corresponding to the plurality of electrical contacts of the electrical connector 110. Mating electrical contacts 114 may include mating electrical contacts connected to the electrical heating device of the water heating enclosure 108, and through which the electrical connector 110 may provide electrical power to the electrical heating device. One or more sensor contacts may also be provided to connect one or more sensor (e.g. water level sensor, temperature sensor, and/or other sensors) to a controller of the humidifier main unit.

In some illustrative embodiments, electrical connector 110 may be structured to maintain the plurality of electrical contacts in a substantially fixed relative spatial relationship. Similarly, the mating electrical contacts 114 of the water heating enclosure 108 may be held by the enclosure in a substantially fixed relative spatial relationship to align with the electrical contacts of electrical connector 110. Such an arrangement of matching alignments may contribute to the ease of making electrical connections between the humidifier main unit and the water heating enclosure 108 via electrical connector 110. In some illustrative embodiments, a "substantially fixed relative spatial relationship" of electrical contacts may include contacts being maintained in essentially rigid positions with respect to each other, but this is not the only way for contacts to be in a substantially fixed relative spatial relationship. In some illustrative embodiments, a relatively small amount of flexibility in the positioning of individual contacts may be permissible while still considering the contacts as being maintained in a substantially fixed relative spatial relationship. In some illustrative embodiments, contacts of an electrical connector 110 may be able to move relative to each other in a limited manner while still considering the contacts as being maintained in a substantially fixed relative spatial relationship. For example, a contact, which could be spring-loaded, could be constrained to move along a defined path relative to other contacts of an electrical connector 110, which could be considered a substantially fixed relative spatial position relative to the other contacts of the electrical connector.

In some illustrative embodiments, the electrical connector 110 may be structured to mate the plurality of electrical contacts with the corresponding mating electrical contacts 114 on the water heating enclosure 108 when the electrical connector is attached to the water heating enclosure in a single action. In some illustrative embodiments, the single action may be, for example, positioning the electrical connector 110 over the connector receptacle 116 of the water heating enclosure 108 and pressing downward on the connector. In some illustrative embodiments, the single action may be, for example, positioning the electrical connector 110 in the connector receptacle 116 of the water heating enclosure 108 and rotating the connector. In some illustrative embodiments, the single action may include a combination of pressing and rotating. More generally, the single action may be one or more motions of the entire electrical connector 110 that result in mating of all of the plurality of electrical contacts of the electrical connector with the corresponding mating electrical contacts 114 of the water heating enclosure 108. The mating of all of the plurality of electrical contacts of the electrical connector with the corresponding mating electrical contacts 114 resulting from the single action may occur substantially simultaneously, or they may occur non-simultaneously (e.g. sequentially)

Alternately, in some embodiments, electrical connections may be made to the water heating enclosure of a humidifier through a connector that requires multiple actions. For example, in some designs, making two electrical connections could require attaching two separate cables, each in a distinct action. That is, distinct manipulations may be needed to attach each of two or more cables separately.

Figure 4:
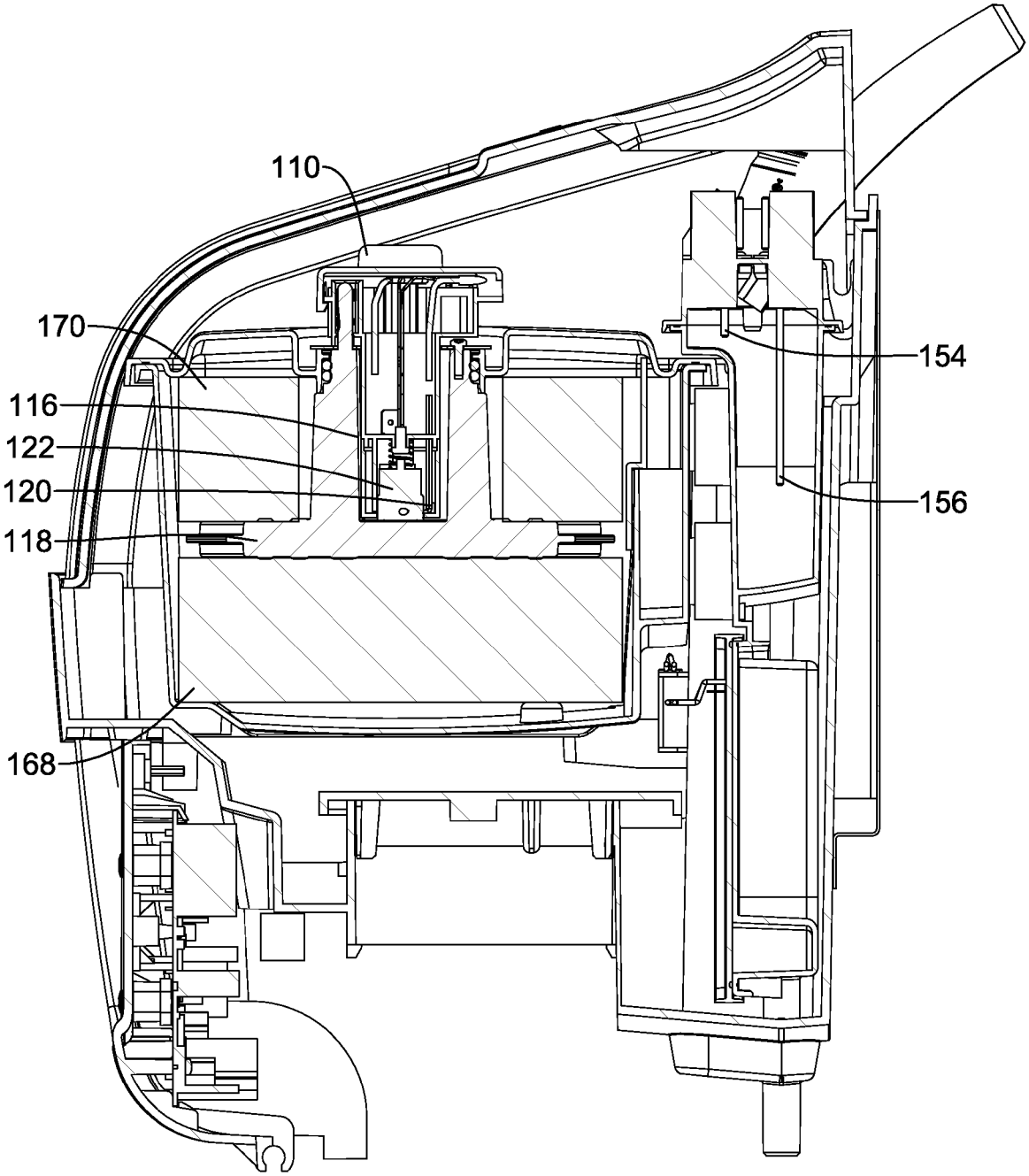
FIG. 4 is a partial cut-away view of the humidifier of FIGS. 1, 2, and 3.

In addition to the plurality of electrical contacts, the electrical connector 110 may include one or more sensor contacts, and in some cases, one or more sensors themselves. For example, in some instances, the electrical connector may be structured to position a temperature sensor in thermal communication with the water heating enclosure when the electrical connector is attached to the water heating enclosure. FIG. 4 is a cut-away view of humidifier 100. In the illustrative embodiment of FIG. 4, electrical connector 110 is shown attached to water heating enclosure 108. A portion of electrical connector 110 is disposed within connector receptacle 116 of the water heating enclosure 108. As illustrated, connector receptacle 116 adjoins electrical heating device 118. Positioning one or more temperature sensors in thermal communication with the water heating enclosure 108 may include positioning one or more temperature sensors in thermal communication with the electrical heating device 118 of the water heating enclosure. An exemplary temperature sensor 120 is shown located at the lower end of electrical connector 110 and adjacent electrical heating device 118 and in thermal communication with the heating device 118. Such a temperature sensor 120 may be employed, for example, to monitor the temperature of heating device 118, with temperature information obtained by the temperature sensor 120 used for control purposes.

When provided, it is contemplated that any suitable temperature sensor may be included in electrical connector 110. For example, a thermistor, a thermalcouple, a solid state, or other suitable temperature sensing technology may be employed in an electrical temperature sensor that provides an electrically-readable signal that may vary continuously with the sensed temperature. Other types of temperature sensors may be employed as well. For example, electrical connector 110 may include a thermal switch 122 that makes or breaks electrical contact as sensed temperature transitions through a thermal switch temperature threshold. In some cases, a bimetallic strip or snap disc may be used for thermal switch 122. Such a thermal switch may provide, for example, a capability for a "fail-safe" power cutoff to prevent thermal runaway, as might occur if a water supply to the humidifier were interrupted and/or water in the water enclosure evaporated away to an undesirably low level.

As described above, the design of humidifier 100 may provide easy and convenient mechanism(s) for connecting and disconnecting water heating enclosure 108 with the humidifier main unit, and for placing and removing thermal sensors in/from thermal communication with the water heating enclosure. In a similar vein, the design of humidifier 100 may include design features that facilitate easy and convenient fluid connections and disconnections. Such easy and convenient fluid connection features may be included in combination with easy and convenient electrical connection features, but it is not necessarily required that a humidifier of the present disclosure include both or either feature sets.

Figure 5:
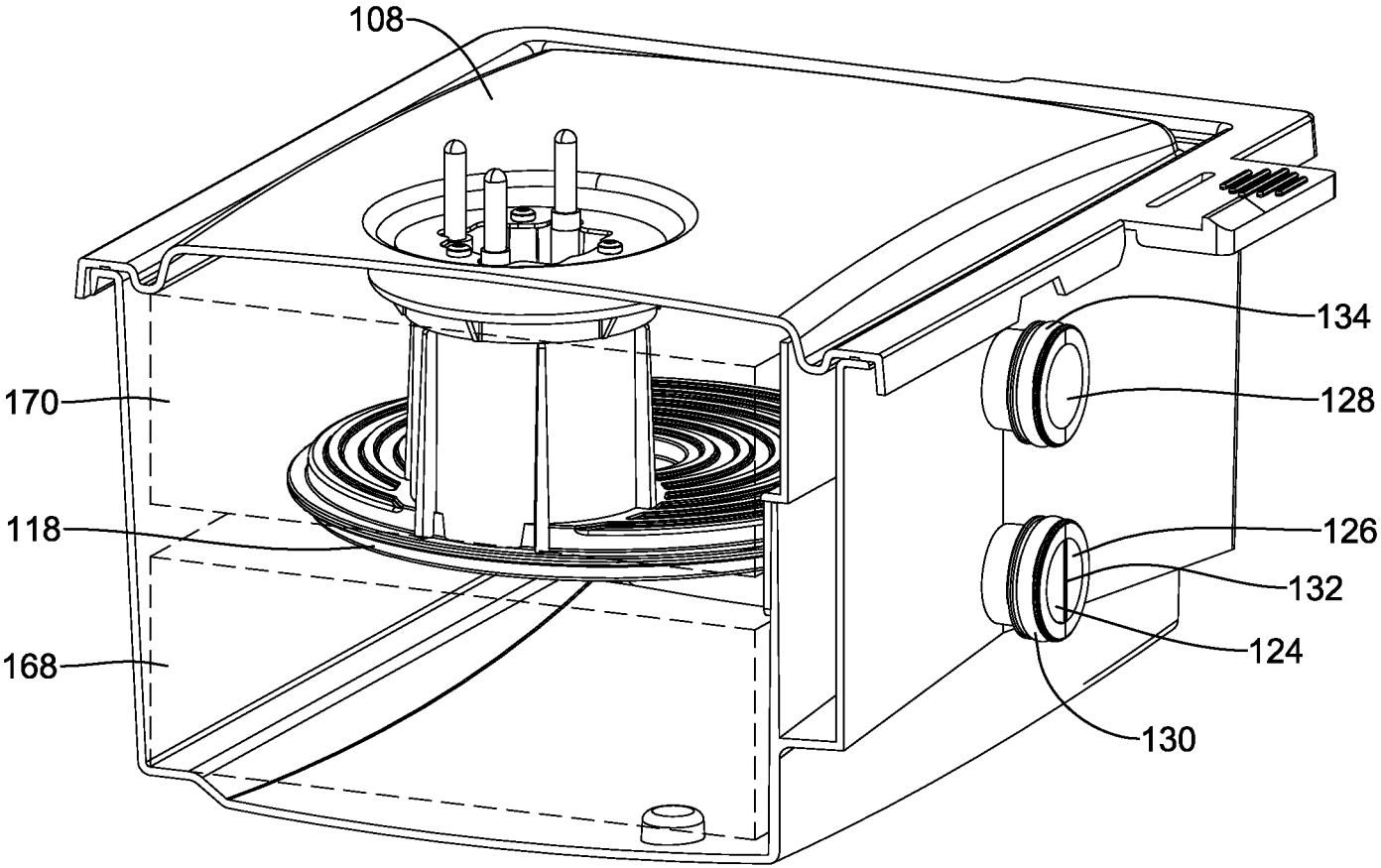
FIG. 5 is a perspective view of the water heating enclosure of FIGS. 1-4 in partial cut-away.

FIG. 5 is a perspective view of water heating enclosure 108 in partial cut-away. The illustrative water heating enclosure 108 may include a bottom surface, a top surface, and side surfaces. Water heating enclosure 108 may include a water inlet 124, a water outlet 126, and a water vapor outlet 128, all disposed on the back surface of the enclosure, though other configuration are contemplated. In the illustrative embodiment of FIG. 5, water inlet 124 and water outlet 126 may share a connector 130 divided by a septum 132, and water vapor outlet 128 may be provided via connector 134. In an alternative embodiment, water inlet 124 and water outlet 126 may share a connector without a septum, or may be provided with separate connectors. In other alternative embodiments, water outlet 126 and water vapor outlet 128 may be combined. In some cases, water inlet 124, water outlet 126 and water vapor outlet 128 may share a connector each separated from the other by a corresponding septum. Other arrangements are also contemplated. In some appliances of the present disclosure, not all of water inlet 124, water outlet 126, and water vapor outlet 128 may be necessary. For example, in some appliances, water levels may be managed such that a water outlet is unnecessary.

Figure 6:
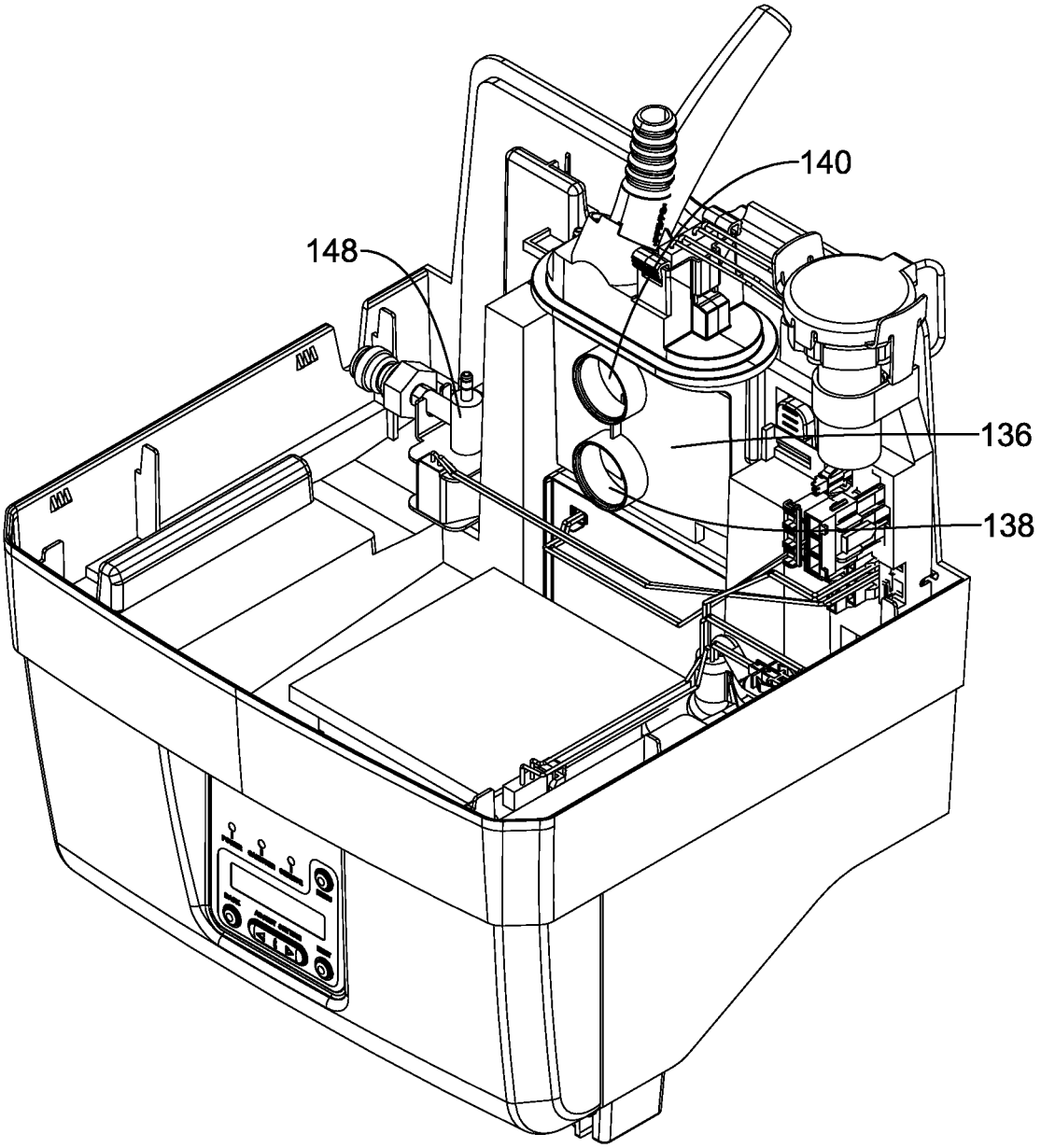
FIG. 6 is a perspective view of the illustrative humidifier of FIGS. 1-4 with the water heating enclosure removed.

The humidifier main unit of humidifier 100 may include features to interface with some or all of water inlet 124, water outlet 126, and water vapor outlet 128. FIG. 6 is a perspective view of the illustrative humidifier 100 of FIGS. 1-4 with water heating enclosure 108 removed. The humidifier main unit may include a manifold 136 structured to fluidically connect or interface with the water inlet 124, the water outlet 126, and the water vapor outlet 128, when the water heating enclosure 108 is received by the humidifier main unit. The manifold 136 may be structured to direct water to the water heating enclosure 108 via the water inlet 124, receive water from the water heating enclosure via the water outlet 126, and receive water vapor from the water heating enclosure via the water vapor outlet 128.

Figure 7:
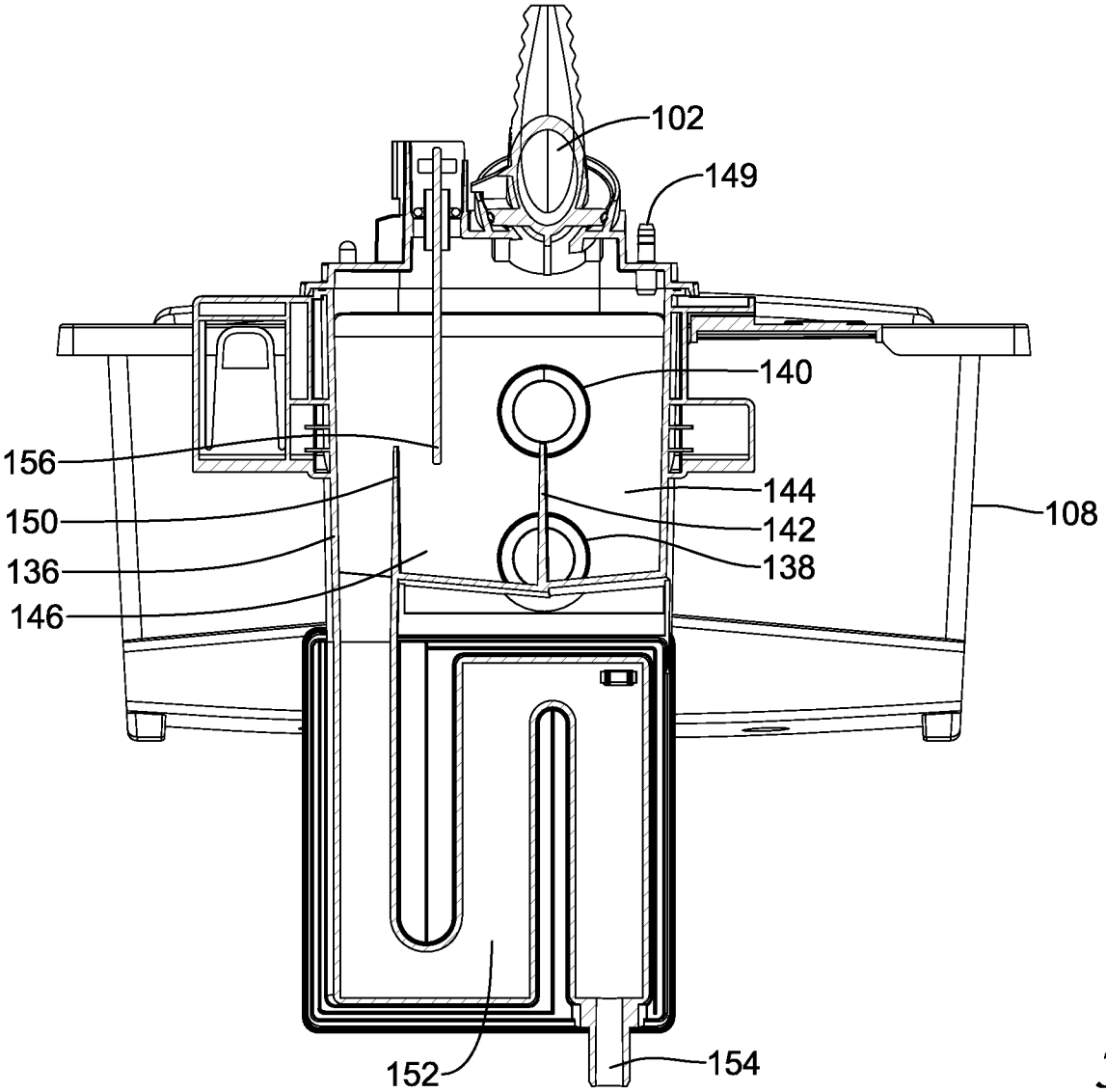
FIG. 7 is a partial cutaway view of a manifold, shown connected to the water heating enclosure.

Some aspects of the construction of the manifold 136 are illustrated in FIG. 6 and FIG. 7. FIG. 7 is a partial cutaway view of the manifold 136, shown connected to the water heating enclosure. The manifold 136 may include mating connectors corresponding to connectors 130, 134 of the water heating enclosure 108, such as mating water connector 138 and mating water vapor connector 140. Fluidic connections between mating pairs of connectors, such as connector 130 for the water inlet 124 and outlet 126 and mating water connector 138, and connector 134 for water vapor outlet 128 and mating water vapor outlet 140, may be achieved in any suitable manner and with any suitable hardware. For example, they may be achieved via one or more press-together connectors, as schematically illustrated in FIGS. 5-7. The press-together connectors may include O-rings, sometimes two sets of O-rings as shown in FIG. 7, which are pressed into receiving apertures 136 and 140 of the manifold 136 to provide a fluid tight seal.

In the illustrative embodiment of FIGS. 1-7, water heating enclosure 108 may be fluidically coupled by translating the enclosure in the backward direction toward the manifold 136, and fluidically de-coupled by translating the enclosure in the forward direction away from the manifold 136. The configuration of water heating enclosure 108 and manifold 136 may be such that fluidic connections between the manifold and the water inlet 124 (and outlet 126) and the water vapor outlet 128 of the water heating enclosure are made substantially simultaneously as the water heating enclosure is translated back toward the manifold 136, as well as being broken substantially simultaneously as the water heating enclosure is translated away from the manifold 136. Humidifier 100 may include safety features to prevent or discourage operation when fluidic connections are not made securely. For example, the humidifier main unit may be structured to prevent closure of the selectively removable panel 106 when the water heating enclosure 108 is disposed in the interior of the humidifier main unit, but the fluidic connections are not made securely. This may be achieved, for example, by dimensioning the humidifier components such that when the water heating enclosure 108 is disposed too far forward (as, e.g., when fluidic connections are not made securely), the water heating enclosure 108 interferes mechanically with closure of the selectively removable top panel 106. To enhance safety, in some cases a cover lock feature (not shown) may be provided to lock the removable top panel 106 in place (e.g. prevent removal) until the temperature of the water in the water heating enclosure 108 falls below a threshold temperature value, but this is not required.

In operation, and when fluidic connections are made between water heating enclosure 108 and manifold 136, water vapor may flow from water heating enclosure via water vapor outlet 128 into the manifold by way of the connector 134 of the enclosure and mating water vapor connector 138 of the manifold. Water vapor port 102 also may be connected to manifold 136 such that water vapor may flow from the manifold via the water vapor port 102 and into, for example, a ventilation duct of an HVAC system. In some embodiments, a humidifier may be structured such that vapor from a water heating enclosure 108 does not pass through a manifold, but is supplied from the water heating enclosure 108 more directly to its destination, for example, via a water vapor outlet of the water heating enclosure 108 straight to an HVAC duct.

With respect to liquid water handling, the manifold 136 may include a septum 142 that divides the manifold into water input 144 and output 146 sides. A water inlet valve 148 (FIG. 6) connected to a water supply (not shown) may control the flow of water via water inlet 149 (see FIG. 7) into the water input side 144 of the manifold 136. Water may return from the water heating enclosure 108 to the water output side 146 of the manifold 136. The manifold may include an overflow barrier 150 on the water output side 146 of the manifold 136. As the water levels in the manifold 136 and the water heating enclosure 108 may be substantially the same under steady-state or nearly-steady state conditions, the overflow barrier 150 may limit the maximum water level in both the manifold 136 and the water heating enclosure 108. The height of water inlet 149 above the nominal water level in the manifold, which may be controlled to be less than the height of overflow barrier 150 and/or setptum 142, may obviate the need for a separate backflow prevention component in humidifier 100.

Downstream of overflow barrier 150, manifold 136 may include a drainage wet trap 152, although this is not necessary. Water may exit the manifold 136 via drain 154. As illustrated in FIG. 7, the manifold 136 may be structured with a valve-less drainage path from the water outlet 126 of the water heating enclosure 108 to drain 154. The valve-less drainage path with drainage wet trap 152 of manifold 136 may provide simple mechanism for over-pressure protection. The drainage wet trap 152 may also provide the function of preventing steam from entering the drain. In some other illustrative embodiments, water may exit a water outlet, which may be valve-less, of a water heating enclosure 108 and drain directly from the humidifier without passing through a manifold or other part of a humidifier main unit. Such a construction may share some of the benefits of the design of manifold 136.

Manifold 136 may include one or more water level sensors, such as normal water level sensor 156 and overfill water level sensor 158 (visible in FIG. 4). Water level sensors may be constructed with stainless steel and/or any other suitable material(s). Normal water level sensor 156 may be used to control the level of water in the manifold 136, and consequently, in the water heating enclosure 108. In some appliances, two separate water level sensors may be used to maintain a water level within a desired height range, with a first sensor used to detect when water is at the upper limit of the range, and a second sensor used to detect when water is at the lower limit of the range. However, in the illustrative embodiment of FIGS. 4 and 7 (and in many other scenarios) a single normal water level sensor 156 may provide sufficient information to control the water level within a desired height range.

Some aspects of operations with a single normal water level sensor 156 are illustrated in the following discussion. Normal water level sensor 156 may be configured to provide an indication when the level of water in the manifold is at or above a reference level of the sensor, and a different indication when the water level is below the reference level. The reference level may be the lowest point of the sensor 156, although other locations on the sensor are possible. A simple closed or open electrical circuit may be the basis of operation of the water level sensor 156. The pool of water in the water heating enclosure 108 may be grounded elsewhere (for example, at the electrical heating device 118 or any other suitable location), and contact (or lack of contact) between the water pool and the normal water level sensor 156 may close (or open) the circuit. Humidifier 100 may be configured to open water inlet valve 148 when the circuit is open (i.e. the water level is below the reference level) and close the inlet valve when the circuit is closed (i.e. the water level is at or above the reference level). As the water level drops (e.g., as liquid water is transformed to vapor), typically a meniscus of water will remain in contact with the reference level of the normal water level sensor 156 even when the mean water level has dropped somewhat below the reference level, due to cohesive forces between water molecules (surface tension) and adhesive forces between water molecules and the material(s) of the sensor. Therefore there generally may be a built-in hysteresis between the variations in the water level and the opening and closing of the sensor circuit (and thus inlet valve). This hysteresis may result in a decrease in the frequency of cycling of the water inlet valve 148, which may be desirable relative to a hysteresis less scenario. In some illustrative embodiments, a period between water draws may be on the order of about three minutes, although this is merely exemplary and longer or shorter periods may be contemplated within the scope of the present disclosure. In some cases an electronic controller may receive the water level sensor output and provide its own hysteresis, if desired.

Figures 8A, 8B:
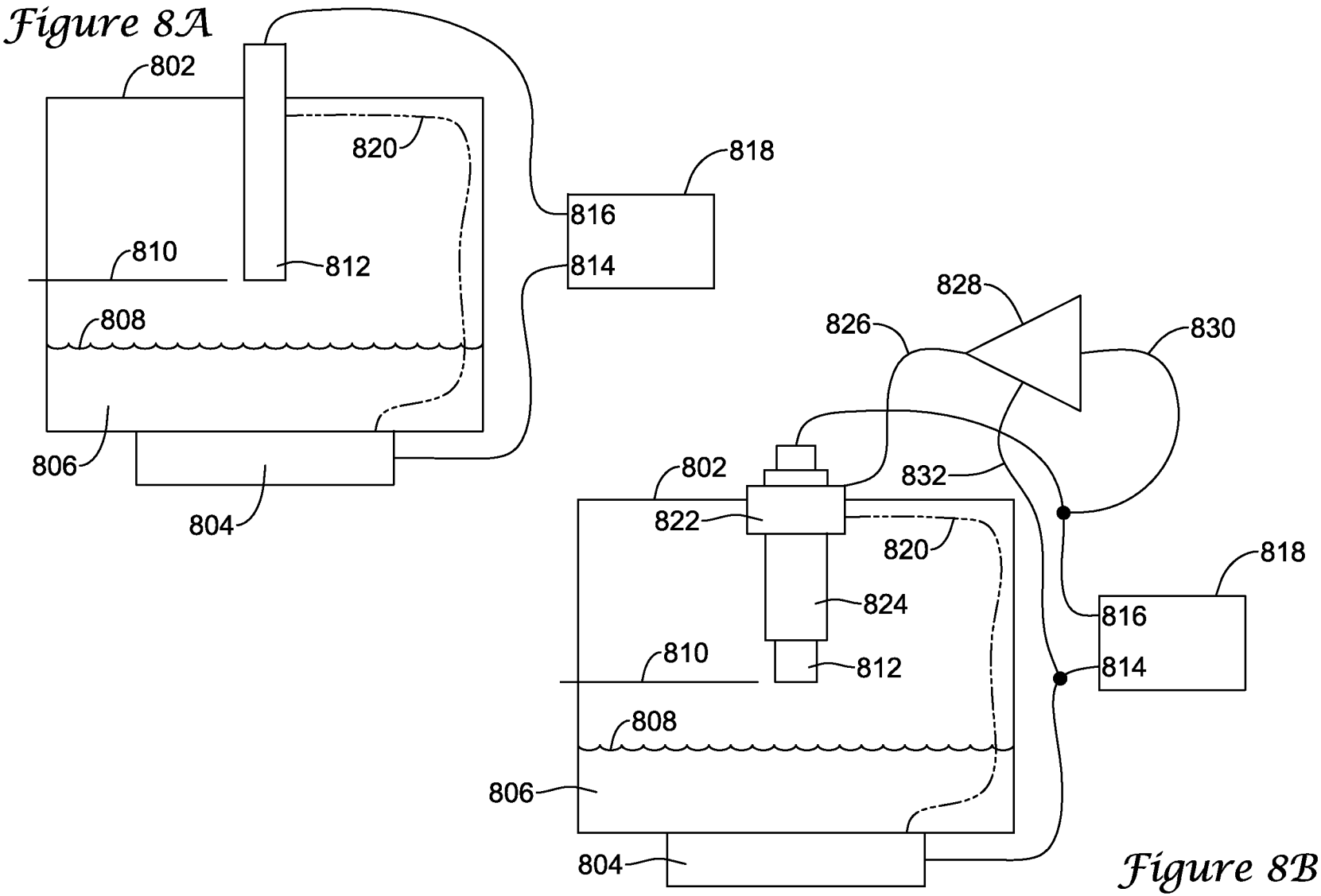
FIG. 8*a* is a schematic diagram of a water reservoir with a non-protected water level sensing circuit susceptible to leakage current.
FIG. 8*b* is a schematic diagram of a water reservoir with a leakage current protected water level sensing circuit.

Water level sensors of the present disclosure may, in some cases, utilize a leakage current protection mechanism. FIG. 8*a* is a schematic diagram of a water reservoir 802 with a non-protected water level sensing circuit susceptible to leakage current. Lower electrode 804 is positioned such that it generally is in conductive contact with water pool 806 regardless of the height of water level 808 (and certainly is in conductive contact if the water level 808 is at or above reference level 810 of upper electrode 812). Leads from electrodes 804 and 812 attach to inputs 814 and 816 of sensing device 818. In normal operation, sensing device 818 detects a closed circuit when water level 808 is at or above reference level 810, due to the electrodes 804 and 812 being conductively connected via water pool 806, or an open circuit when the water level is below the reference level (as illustrated in FIG. 8*a*). However, and undesirable leakage current along leakage current path 820 can conductively connect the electrodes 804 and 812 and short circuit the level sensing circuit, leading to a false indication that the water level is at or above the reference level. The leakage current path 820 may, for example, be formed due to condensation or contamination such as a conductive fluid film on the interior surfaces of water reservoir 802.

FIG. 8*b* is a schematic diagram of a water reservoir 802 with a leakage current protected water level sensing circuit. The leakage current protection mechanism includes a guard electrode 822 and an insulator 824 disposed between the guard electrode and the upper electrode 812. The guard electrode 822 is connected to the output 826 of a voltage follower 828. Voltage follower 828 may comprise an operational amplifier or any other suitable electronic circuitry. The input 830 of the voltage follower 828 is shown connected to input 816 of the sensing device 818, and the common 832 of the voltage follower is connected to the other input 814 of the sensing device, as well as lower electrode 804.

The leakage current protection mechanism may help prevent leakage current from passing through inputs 814 and 816 of the sensing device 818. The guard electrode 822 is located such that any surface (leakage) current that would otherwise flow to upper electrode 812 in the absence of the guard electrode 822 instead reaches the guard electrode 822 first. The guard electrode 822 may, for example, be shaped as a ring around the insulator 824 and upper electrode 812, but any suitable shape can be used. Leakage current that enters the guard electrode 822 flows into the output 826 of the voltage follower 828, and subsequently flows out of the follower via common 832, to lower electrode 804. Thus, the leakage current bypasses the inputs 814 and 816 of the sensing device 818, and the sensing device does not does not indicate a closed circuit due to the leakage current. The leakage current protection mechanism does not interfere with the operation of the water level sensing circuit when the water level 808 is at or above the reference level 810.

Figure 9:
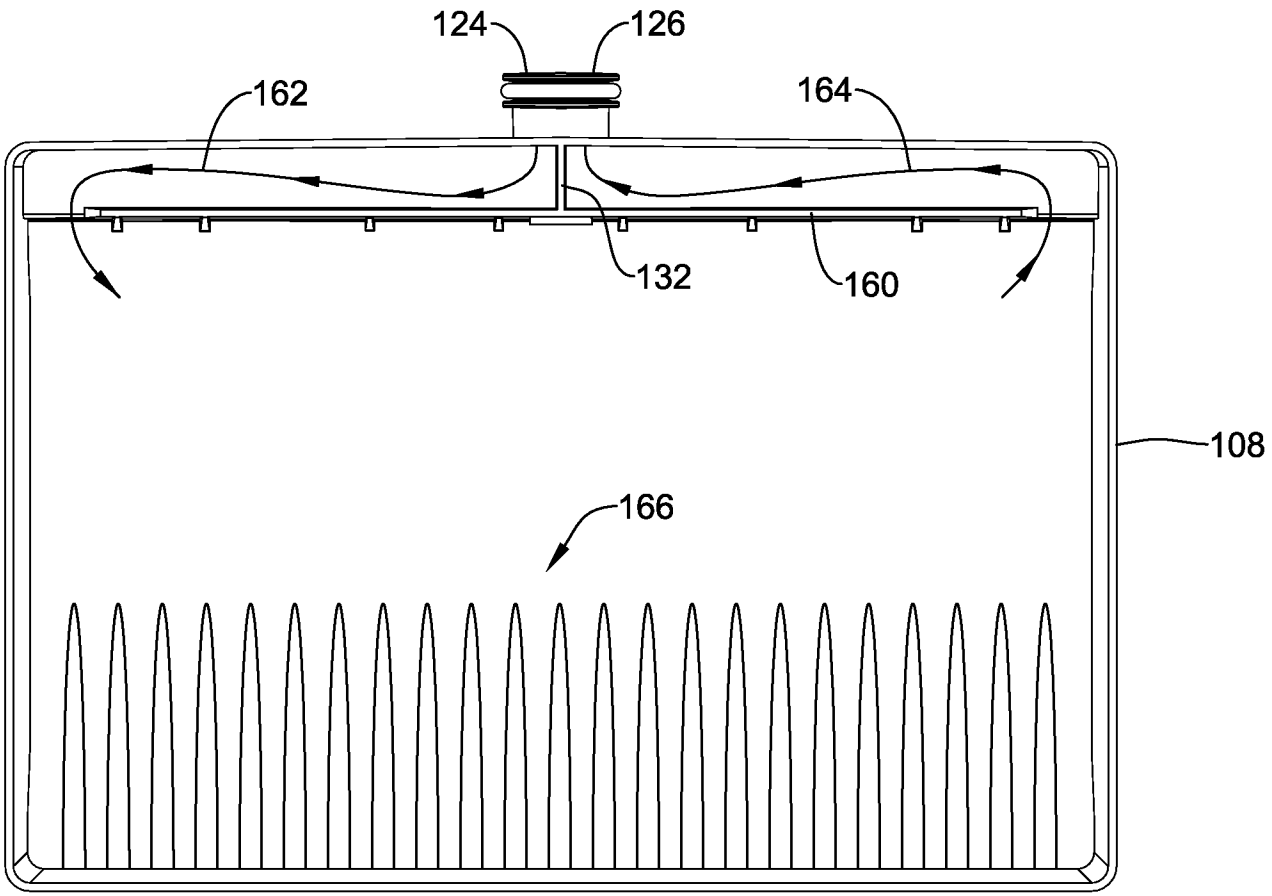
FIG. 9 is a partial cut-away view of the water heating enclosure.

Accuracy of water level measurement in the manifold may, in some cases, be enhanced by structures in the water heating enclosure 108. FIG. 9 is a partial cut-away view of the water heating enclosure 108. In FIG. 9, the water heating enclosure 108 may include a wall 160 that may extend to the top and bottom of the interior of the water heating enclosure 108, such that liquid and/or water vapor cannot pass between the wall and the top and bottom of the water heating enclosure 108. The wall 160 may extend considerably toward the left and right sides of the interior of the water heating enclosure 108, but leaving a path for liquid water flow in and out of the main body of the enclosure on input 162 and output 164 sides, respectively, as well as paths for water vapor to flow toward the water vapor outlet 128. Such a wall 160 may contribute to less variation in water height within the manifold 136, as might be caused, for example, by boiling of water in the water heating enclosure 108. Furthermore, such a wall 160 may reduce contamination of the manifold 136 from the water heating enclosure 108 by scale and the like, which could over time adversely affect the performance of water level sensors located in the manifold. Routing of water flow by the wall 160 may also assist the efficacy of flushing or purging of the water heating enclosure 108.

Flushing is one technique that may be employed to counter scale buildup. As water is evaporated from a water reservoir during operation of the humidifier 100, the concentration of soluble minerals in the water reservoir may increase, leading to a higher rate of solute precipitation and scale formation, and possibly also changing boiling characteristics of the liquid. Flushing may be employed to lower the solute concentration in the reservoir. Flushing may also help remove loose debris in the water reservoir by entraining it in the water flow during flushing. In some humidifier designs, a drain valve may be used to control drainage from the reservoir. In such a design, flushing may be accomplished by draining the reservoir via the drain valve, then closing the value prior to refilling. However, the drain valve may be subject to a variety of failure modes, including some possibly resulting from scale buildup. Some (but not necessarily all) illustrative embodiments may forego a drain valve, eliminating the associated costs and failure modes. As discussed in relation to FIG. 7 elsewhere herein, manifold 136 may be structured with a valve-less drainage path from the water outlet 126 of the water heating enclosure 108 to drain 154. Flushing may be performed by introducing water into water heating enclosure 108 at a rate greater than that needed to replenish water lost by evaporation. Excess water may exit the water heating enclosure 108 via water outlet 126, pass over the overflow barrier 150, and exit the humidifier via drain 154. In such a scenario, normal water level sensor 156 would be expected to indicate the presence of water at its reference level during a flushing action. Overfill water level sensor 158 could be expected to provide an emergency indication of water exceeding expected heights within the manifold 136, and by implication, the water heating enclosure 108, as might occur if drain 154 were plugged. As noted elsewhere, other drainage architectures are contemplated, including having water exit a water outlet of a water heating enclosure 108 and drain directly from the humidifier 100 without passing through a manifold 136 or other part of a humidifier main unit. In some such instances, the water heating enclosure itself may incorporate a valve-less drainage path using an overflow barrier.

When provided, any suitable flushing routine may be practiced, such as overfilling the water heating enclosure 108 for a specified amount of time or with a specified volume of water after a specified period of water vapor production has elapsed. For example, after producing water vapor for 24 hours, the water heating enclosure 108 may be flushed for five minutes, although these time values are merely exemplary. In some cases, the heater unit may be turned off during the flushing operation, but this is not required. Any other suitable flushing strategies may be employed, such as those described in U.S. Patent Application Publication No. 2011/0140291 (Hoglund), which is hereby incorporated by reference.

While flushing strategies may mitigate scale production, buildup, and accumulation, the phenomena generally will not be eliminated entirely, and therefore other strategies for combating their deleterious effects may be used. One strategy may be to expose water in the water reservoirs to relatively large quantities of scale collection surfaces. Scale may potentially accumulate on nearly any surface exposed to water with a high dissolved mineral concentration. By providing more surface area for scale to accumulate upon, a smaller fraction of the total amount of scale may accumulate where its negative impacts are greatest, such as on the heating device 118 immersed in the water reservoir. In some instances, water heating enclosure 108 of humidifier 100 may include structures with scale collection surfaces exposed to water in the water heating enclosure 108 when in normal use. The scale collection surfaces may be provided on any suitable structure or structures. The water-contacting surfaces of the water heating enclosure 108 walls may provide scale collection surfaces. Water heating enclosure 108 may include scale collection surfaces that project into an interior of the water heating enclosure 108, for example from the outer walls of the water heating enclosure 108 inward toward the interior of the water heating enclosure 108. Such interior projections 166 are represented schematically in FIG. 9. Interior projections 166 may take any suitable form. They may, for example, include detailed structure to provide a high amount of surface area. They also may, for example, be shaped to facilitate flow of water (liquid and/or vapor) within the water heating enclosure 108. In some cases, the interior projections 166, when provided, may be integrally molded with the outer housing of the water heating enclosure 108. In other instances, the interior projections 166 may be separately formed and inserted into the water heating enclosure 108.

Figure 10:
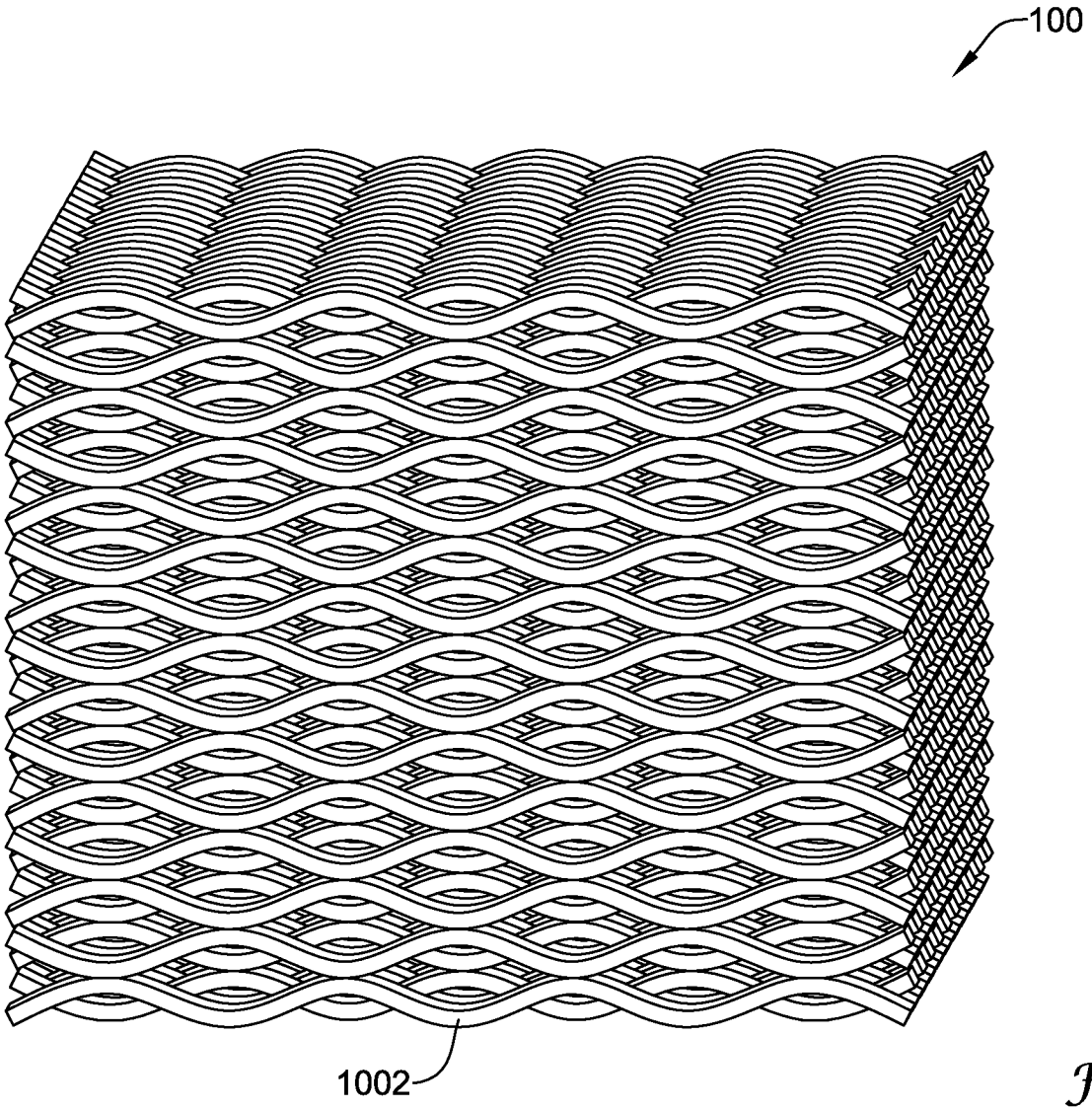
FIG. 10 is a schematic view of an illustrative scale collector.

Scale collection surfaces may be provided on separately manufactured components that may be disposed in water reservoirs either permanently or replaceably. For example, it is contemplated that water heating enclosure 108 may include one or more scale collectors 168, 170, depicted in phantom outline in FIG. 5, and also shown schematically in FIG. 4. The scale collectors 168, 170 may provide scale collection surfaces for collecting scale. It is contemplated that scale collectors 168, 170 may take any suitable form, such as a matrix, lattice, mesh, or other filter-like form. Scale collectors 168, 170 may include, for example, an expanded mesh construction, similar to expanded aluminum, plastic, or paper humidifier pads used in flow-through evaporative humidifiers. While the applications are different, having a high surface area may be helpful in both evaporative humidifier pads and the present scale collectors. One such a scale collector 1000 is depicted schematically in FIG. 10, although the depiction of FIG. 10 should not be considered to be limiting. The scale collector 1000 may include a network of crisscrossing ribs 1002 that allow water (liquid and/or vapor) to flow between the crisscrossing ribs, but provides a large surface area to collect scale. It is contemplated that scale collector constructions differing from that represented schematically in FIG. 10 may include expanded mesh, crisscrossing ribs, and/or any other suitable construction, formed with any suitable material or materials, as desired.

Scale collectors may be disposed in the water reservoir in any suitable arrangement. In some appliances, a water heating device may be surrounded on at least two sides by one or more scale collectors, but this is not required. In the illustrative embodiment of FIGS. 4 and 5, electrical heating device 118 is surrounded both above and below by scale collectors 168 and 170. Scale collector 168 is disposed below electrical heater 118 and scale collector 170 is disposed above the heater. Scale collectors may or may not be entirely submerged in water. In the illustrative embodiment of FIGS. 4 and 5, scale collector 168 and heating device 118 generally would be entirely submerged in water when the humidifier 100 is in operation, and at least a portion of scale collector 170 is immersed in water. A portion of scale collector 170 may be disposed above the water level present in water heating enclosure 108, if desired.

Appliances may be designed such that at least some scale collectors are field-replaceable, as may be desirable after scale has been collected on their scale collection surfaces. Water heating enclosure 108 may be constructed to be at least partially disassemblable (for example, the top cover of the enclosure may be selectively removable) such that either or both of scale collectors 168 and 170 can be removed and replaced, thereby replacing at least some of the scale collection surfaces of the water heating enclosure 108. In other embodiments, water heating enclosure 108 may be constructed such that is it not intended to be disassemblable. Techniques such as spin or vibration welding may be used to seal the enclosure 108 during the manufacturing process. When the water heating enclosure 108 is not disassemblable, the entire water heating enclosure 108 may be replaced. That is, in some illustrative embodiments, the scale collection surfaces may be replaced by replacing the entire water reservoir, including the scale collection surfaces provided therein. There may be other reasons to replace a water reservoir other than renewal of scale collection surfaces, and such capability may be provided even in embodiments where the water reservoir is disassemblable. As described further elsewhere herein, humidifier 100 may be structured and configured for easy field replacement of water heating enclosure 108. In some cases, water heating enclosure 108 may be designed for a pre-determined or pre-estimated service life with regard to scale accumulation and other factors, taking into account factors such as water hardness, quantity of scale collection area, humidification demand, etc.

Scale collection surfaces may be described quantitatively in terms of their area, which may be referred to as scale collection surface area. Any water reservoir may have at least some scale collection surface area in the form of the water-contacting walls of its enclosure, but some water reservoirs may be provided with scale collection surface area somewhat or considerably in excess of that needed to enclose the water. For purposes of this disclosure, we define a reference surface area for any water reservoir or enclosure as being the surface area of a sphere having a volume equal to the water volume of the water reservoir or enclosure. Scale collection surface area for a water enclosure may be described relative to the reference surface area of the enclosure. In some illustrative embodiments, water heating enclosures, water boiling chambers, or other water reservoirs, such as water heating enclosure 108, may have a scale collection surface area that is at least two, four, five, eight, ten, 20, 50, 100 or more times greater than its reference surface area. Such ratios of scale collection surface area to reference surface area typically exceed that of a water reservoir not purposely designed with high scale collection surface area.

In an illustrative embodiment, the present disclosure may provide an appliance that includes an enclosure for carrying a water volume within which one or more scale collectors are disposed. The one or more scale collectors may be configured to allow water in the enclosure to flow around scale collection surfaces of the one or more scale collectors. A circulation mechanism may be provided to help circulate water in the enclosure such that water flows around the scale collection surfaces of the one or more scale collectors. The circulation mechanism may, for example, include a mechanical pump, but this is not necessary. In some instances, the circulation mechanism may include a heater that heats water in the enclosure such that convection circulates the water in the enclosure and around the scale collection surfaces of the one or more scale collectors. The appliance may be a steam humidifier, but this is not required. The appliance may be configured to allow field replacement of components. For example, the enclosure and/or one or more scale collectors may be field replaceable, if desired.

The present disclosure includes any corresponding methods for exploiting the devices of the disclosure. For example, a method for capturing scale in a steam humidifier is provided. The method may include providing scale collection surfaces in an enclosure, such that the scale collection surfaces have a scale collection surface area that is at least two times greater than the reference surface area as defined herein. The method may further include supplying energy to water in the enclosure sufficient to boil at least some of the water in the enclosure, and replacing at least some of the scale collection surfaces after scale has been collected. Scale collection surface areas may be provided and replaced in any suitable manner consistent with the devices described herein.

Appliances of the present disclosure may be configured for easy component replacement. Any suitable components may be configured in any suitable manner to facilitate component replacement. For example, snap fit connections may be employed for securing replaceable components in the appliance, and electrical connections may be made with removable connectors. Components suited for easy replacement may include, but are not limited to, water heating enclosure 108, water inlet valve 148, manifold 136, electrical connector 110, water level sensors 156, 158, and other components not otherwise discussed herein such as controller circuit boards, leak detection sensors, interlock switches, and so on.

The disclosure should not be considered limited to the particular examples described above, but rather should be understood to cover all aspects of the disclosure and equivalents thereof. Various modifications, equivalent processes, as well as numerous structures to which the disclosure can be applicable will be readily apparent to those of skill in the art upon review of the instant specification.

What is claimed is:

1. A humidifier, comprising:

a field-replaceable water heating enclosure, the enclosure including:

a water inlet;

a water outlet;

a water vapor outlet;

a resistive heating element;

a humidifier main unit configured to receive the field-replaceable water heating enclosure, the humidifier main unit further configured to:

provide water to the field-replaceable water heating enclosure via the water inlet when the field-replaceable water heating enclosure is received by the humidifier main unit; and provide electrical power to the resistive heating element of the field-replaceable water heating enclosure when the field-replaceable water heating enclosure is received by the humidifier main unit.

2. The humidifier of claim 1, wherein the humidifier main unit is configured to provide electrical power to the resistive heating element of the field-replaceable water heating enclosure via an electrical connector, wherein the electrical connector includes a plurality of electrical contacts, including a pair of electrical contacts configured to provide electrical power to the resistive heater element, wherein each of the plurality of electrical contacts correspond to a mating electrical contact on the field-replaceable water heating enclosure, and wherein the electrical connector is structured to maintain the plurality of electrical contacts in a substantially fixed relative spatial relationship.

3. The humidifier of claim 2, wherein the electrical connector is structured to mate the plurality of electrical contacts with the corresponding mating electrical contacts on the field-replaceable water heating enclosure when the electrical connector is attached to the field-replaceable water heating enclosure in a single action.

4. The humidifier of claim 3, wherein the electrical connector includes one or more temperature sensors, wherein the electrical connector is structured to position the one or more temperature sensors in thermal communication with the field-replaceable water heating enclosure when the electrical connector is attached to the field-replaceable water heating enclosure.

5. The humidifier of claim 1, wherein:

the field-replaceable water heating enclosure includes a bottom surface, a top surface, and side surfaces; and the water inlet, the water outlet, and the water vapor outlet are disposed on one of the side surfaces of the field-replaceable water heating enclosure.

6. The humidifier of claim 1, wherein the humidifier main unit includes a manifold structured to interface with the water inlet, the water outlet, and the water vapor outlet, when the field-replaceable water heating enclosure is received by the humidifier main unit, wherein the manifold of the humidifier main unit is structured to direct water to the field-replaceable water heating enclosure via the water inlet, receive water from the field-replaceable water heating enclosure via the water outlet, and receive water vapor from the field-replaceable water heating enclosure via the water vapor outlet.

7. A humidifier, comprising:

a field-replaceable water heating enclosure, the enclosure including:

a water inlet;

a water outlet;

a water vapor outlet;

an electrical heating device;

a humidifier main unit configured to receive the field-replaceable water heating enclosure, the humidifier main unit further including:

an electrical connector, including:

a plurality of electrical contacts, including a pair of electrical contacts configured to provide electrical power to the electrical heating device, wherein each of the plurality of electrical contacts correspond to a mating electrical contact on the field-replaceable water heating enclosure; and wherein the electrical connector is structured to maintain the plurality of electrical contacts in a substantially fixed relative spatial relationship.

8. The humidifier of claim 7, wherein the electrical connector is structured to mate the plurality of electrical contacts with the corresponding mating electrical contacts on the field-replaceable water heating enclosure when the electrical connector is attached to the field-replaceable water heating enclosure in a single action.

9. The humidifier of claim 7, wherein the electrical connector further includes one or more temperature sensors, wherein the electrical connector is structured to position the one or more temperature sensors in thermal communication with the field-replaceable water heating enclosure when the electrical connector is attached to the field-replaceable water heating enclosure.

10. The humidifier of claim 9, wherein the one or more temperature sensors include an electrical temperature sensor that provides an electrically-readable signal that varies continuously with sensed temperature.

11. The humidifier of claim 9, wherein the one or more temperature sensors include a thermal switch that makes or breaks electrical contact as sensed temperature transitions through a thermal switch temperature.

12. The humidifier of claim 7, wherein the main unit further includes an outer enclosure, the outer enclosure including a selectively removable panel to provide access to an interior of the humidifier main unit through which the field-replaceable water heating enclosure can be replaced in the field.

13. The humidifier of claim 7, wherein the humidifier main unit includes a manifold structured to interface with the water inlet, the water outlet, and the water vapor outlet, when the field-replaceable water heating enclosure is received by the humidifier main unit, wherein the manifold of the humidifier main unit is structured to direct water to the field-replaceable water heating enclosure via the water inlet, receive water from the field-replaceable water heating enclosure via the water outlet, and receive water vapor from the field-replaceable water heating enclosure via the water vapor outlet.

14. A humidifier, comprising:

a field-replaceable water heating enclosure, the enclosure including:

a water inlet;

a water vapor outlet;

a heating device configured to heat water in the field replaceable water heating enclosure; and a humidifier main unit configured to receive the field-replaceable water heating enclosure, and to provide water to the field-replaceable water heating enclosure via the water inlet and receive water vapor from the field-replaceable water heating enclosure via the water vapor outlet, the humidifier main unit including a manifold structured to fluidically connect with the water inlet and the water vapor outlet when the field-replaceable water heating enclosure is received by the humidifier main unit.

15. The humidifier of claim 14, wherein fluidic connections between the manifold and the water inlet and the water vapor outlet of the field-replaceable water heating enclosure are achieved via one or more press-together connectors.

16. The humidifier of claim 14, wherein the humidifier main unit and the field-replaceable water heating enclosure are configured such that fluidic connections between the manifold and the water inlet and the water vapor outlet of the field-replaceable water heating enclosure are made substantially simultaneously as the field-replaceable water heating enclosure is translated toward the manifold.

17. The humidifier of claim 14, wherein the humidifier main unit further includes an outer enclosure, the outer enclosure including a selectively removable panel to provide an access port to an interior of the humidifier main unit through which the field-replaceable water heating enclosure may be replaced.

18. The humidifier of claim 17, wherein when the field-replaceable water heating enclosure is disposed in the interior of the humidifier main unit but fluid connections are not made securely, the humidifier main unit is structured to prevent closure of the selectively removable panel.

19. The humidifier of claim 14, wherein the field-replaceable water heating enclosure includes a water outlet, and the manifold is structured to fluidically connect with the water outlet when the field-replaceable water heating enclosure is received by the humidifier main unit, the manifold is further structured with a valve-less drainage path from the water outlet of the field-replaceable water heating enclosure to a drain.

20. The humidifier of claim 19, wherein the valve-less drainage path is structured with an overflow barrier that limits the maximum water level in the field-replaceable water heating enclosure.

* * * * *